US007980553B2

(12) United States Patent
Haflinger et al.

(10) Patent No.: US 7,980,553 B2
(45) Date of Patent: Jul. 19, 2011

(54) MEDIA MEASUREMENT WITH SENSOR ARRAY

(75) Inventors: James J. Haflinger, San Diego, CA (US); Arthur K. Wilson, San Diego, CA (US); Gary A. Kneezel, Webster, NY (US)

(73) Assignee: Eastman Kodak Company, Rochester, NY (US)

( * ) Notice: Subject to any disclaimer, the term of this patent is extended or adjusted under 35 U.S.C. 154(b) by 103 days.

(21) Appl. No.: 12/332,616

(22) Filed: Dec. 11, 2008

(65) Prior Publication Data

US 2010/0148432 A1 Jun. 17, 2010

(51) Int. Cl.
*B65H 1/18* (2006.01)

(52) U.S. Cl. ..... 271/152; 271/154

(58) Field of Classification Search ..... 271/152–156, 271/110, 111; 250/559.23, 559.27, 559.19, 250/559.26, 559.29, 559.31, 559.38, 559.4; 356/631

See application file for complete search history.

(56) References Cited

U.S. PATENT DOCUMENTS

| | | | | |
|---|---|---|---|---|
| 4,053,234 | A * | 10/1977 | McFarlane | 356/631 |
| 5,028,041 | A | 7/1991 | Kobayashi | 271/9 |
| 5,110,106 | A | 5/1992 | Matsumura et al. | 271/9 |
| 5,222,729 | A * | 6/1993 | Wallaschkowski | 271/262 |
| 5,360,207 | A | 11/1994 | Rauen et al. | 271/265 |
| 5,573,236 | A | 11/1996 | Petocchi et al. | 271/265.02 |
| 5,700,003 | A | 12/1997 | Sung | 271/110 |
| 5,847,405 | A * | 12/1998 | Acquaviva et al. | 250/559.36 |
| 6,408,147 | B1 | 6/2002 | Oshida | 399/82 |
| 6,585,341 | B1 * | 7/2003 | Walker et al. | 347/14 |
| 6,805,345 | B2 | 10/2004 | Furukawa | 271/171 |
| 6,830,398 | B2 | 12/2004 | Yokoi | 400/582 |
| 6,901,820 | B2 | 6/2005 | Imahara | 73/865.8 |
| 7,049,619 | B2 * | 5/2006 | Hahn et al. | 250/556 |
| 7,055,925 | B2 | 6/2006 | Subirada et al. | 347/19 |
| 7,120,272 | B2 | 10/2006 | Guiguizian | 382/100 |
| 7,350,902 | B2 | 4/2008 | Dietl et al. | 347/43 |
| 7,374,163 | B2 | 5/2008 | Cook et al. | 271/145 |
| 7,401,878 | B2 | 7/2008 | Chelvayohan et al. | 347/16 |
| 2002/0135628 | A1 | 9/2002 | Kolodziej | |
| 2003/0213924 | A1 | 11/2003 | Yamaguchi et al. | |
| 2006/0187441 | A1 | 8/2006 | Sugiyama et al. | |

FOREIGN PATENT DOCUMENTS

| | | | |
|---|---|---|---|
| FR | 2 786 758 | A1 | 6/2000 |
| WO | WO 2005/022127 | A2 | 3/2005 |

* cited by examiner

*Primary Examiner* — Jeremy Severson
(74) *Attorney, Agent, or Firm* — Stephen H. Shaw; Eugene I. Shkurko

(57) ABSTRACT

A method for measuring dimensions of a stack of medium in a media input location of an imaging system, includes emitting light along a direction that is at a predetermined angle with respect to the normal of the planar surface of the media input location. An array of photosensors are disposed along an array direction that lies in a plane defined by the direction of the light and the normal of the planar surface. The photosensors receive a spatially-varying pattern of light reflected from a surface that is substantially parallel to the planar surface of the media input location to provide corresponding electronic signal data from the photosensor array for subsequent transmission to a printing system controller. The varying electronic signal data is used to provide a measurement of the one or more dimensions corresponding to the stack of medium.

24 Claims, 11 Drawing Sheets

MEDIA MEASUREMENT WITH SENSOR ARRAY

CROSS-REFERENCE TO RELATED APPLICATIONS

Reference is made to commonly assigned, co-pending U.S. Patent Applications:

U.S. patent application Ser. No. 12/332,670, filed herewith, entitled: "MEDIA IDENTIFICATION SYSTEM WITH MOVING OPTOELECTRONIC DEVICE", by T. D. Pawlik;

U.S. patent application Ser. No. 12/332,722, filed herewith, entitled: "MOVABLE MEDIA TRAY WITH POSITION REFERENCE MARKS", by D. V. Brumbaugh et al., the disclosure(s) of which are incorporated herein; and U.S. patent application Ser. No. 12/332,648, filed herewith, entitled: "MEDIA IDENTIFICATION SYSTEM WITH SENSOR ARRAY", by T. D. Pawlik et al.; the disclosures of which are incorporated herein.

FIELD OF THE INVENTION

The present invention relates generally to the field of measuring dimensions of paper or other media in a stack, and more particularly to measuring media in an input tray of a printer or other imaging system.

BACKGROUND OF THE INVENTION

In a printer, a copier or other imaging system, paper or other media is loaded as a stack of cut sheets at a media input location, such as an input tray. For example, blank paper or other recording media is loaded into one or more input trays so that it can be printed. How much media is left in the input tray is not always readily apparent to the user because of the design and location of the input tray. Yet the information of how much media remains is useful for managing the printing operation, as well as for an early warning that more media will be needed to be supplied. As a first example, suppose a user requests a print job requiring 20 sheets of media, but only 10 sheets are actually in the input tray. If the user leaves the printing job unattended and comes back later, he will be disappointed to find that the printing job is unfinished because the printer ran out of paper. As a second example, if a user has a job that needs to be printed, but does not realize he is almost out of paper, he may need to make a special trip to get more, thus causing delays in printing the job. In this example, an early warning would be helpful so that the user can get more paper before his local supply runs out.

Proper advancing of a piece of medium, interchangeably referred to as media, herein, through the imaging system is related to the thickness of the medium that has been advanced. In many imaging systems, a media feed roller is controlled by either a stepper motor or a motor whose amount of rotation is monitored by a rotary encoder. In either case, the rotation of the feed roller is well controlled. However, the distance that a piece of medium is advanced by the feed roller also depends upon the thickness of the piece of medium.

Furthermore, sometimes multiple pieces of medium are inadvertently fed from the media input location. This can result in paper jams, i.e. pieces of medium becoming stuck in the media advancing system, so that the user needs to open the imaging system and remove the stuck pieces of medium. In printing systems having a printhead that is scanned back and forth across the recording medium while printing, the inadvertent feeding of multiple sheets can cause the printhead to crash into the recording medium, possibly doing damage to the printhead.

A quick and accurate measurement of the change of height of a stack of media at or shortly after the time when a piece of medium has been advanced from the media input location would be advantageous. In some circumstances, change in height of the stack of media could be related to the thickness of the piece of medium that has just been advanced, thus providing useful information for accurate feeding of the medium. In other circumstances, change of height of the stack of media could provide an early warning of inadvertent feeding of multiple pieces of medium.

Several ways for measuring the height of a stack of media at a media input location of an imaging system have been described in the prior art. U.S. Pat. Nos. 5,028,041; 6,408,147; and 7,374,163; disclose a rotatable arm that rests on the top piece of medium in the stack of media. The arm is attached to a flag which interrupts the passage of an amount of light to one or more photosensors. Commonly assigned, co-pending U.S. patent application Ser. No. 12/178,849, discloses a height-dependent blocker of light, where the blocker of light is attached to the pick-up arm that houses the media pick-up roller in the media input tray, and the height is set by the pick-up roller. U.S. Pat. No. 5,700,003, discloses a rotatable arm that rests on the top piece of medium in the stack, and the other end of the rotatable arm turns a wiper in a variable resistor to provide a resistance that depends on stack height (or alternatively a voltage that depends on stack height if the variable resistor is part of a voltage divider). U.S. Pat. No. 7,401,878; discloses a wheel having multiple reflectance characteristics, where the different reflectance characteristics represent different stack heights, and the wheel is rotated by a drive mechanism that is coupled between the stack height and the wheel.

Although the prior art patents are able to provide an approximate height of the stack of media (for example: full, nearly full, nearly empty, or empty), they are typically not sufficiently sensitive to also provide an accurate measurement of the change of height of the media stack after a single medium feed event. Therefore, they are not able to measure the thickness of a piece of medium that has been fed, and they are not able to sense the inadvertent feeding of multiple pieces of medium.

In addition, it is advantageous for the imaging system to know the length of the piece of medium that is being advanced through the system. Several patents (for example: U.S. Pat. Nos. 5,110,106; 5,573,236; 5,360,207; 6,805,345; and 6,901,820), describe ways of detecting the position of edge guides that are set to butt against the edges of a stack of media. However, such methods would not be capable of detecting that a shorter piece of medium was mixed into the stack (left over, for example, from a media load event prior to loading the stack and setting the edge guides).

Furthermore, some types of recording medium for printers (such as inkjet printers), have manufacturer's code markings on the backside of the sheets in order to identify the type of recording medium. This is done so that the printing system controller will be able to recognize what type of recording medium is present (glossy photo media versus plain paper, for example) so that the image can be appropriately rendered to provide optimized image quality on that type of recording medium. Commonly assigned, co-pending U.S. patent application Ser. Nos. 12/332,670; 12/332,722; and 12/332,648; provide ways of identifying media type by sensing the manufacturer's markings. These ways of identifying media types are sufficient for some printing systems. However, these ways of identifying recording medium types would not also provide an accurate measurement of the media stack height.

What is needed is a way to measure the media stack height to sufficient precision, so that the thickness of an individual sheet can be measured, or the inadvertent advancement of multiple sheets can be detected.

SUMMARY OF THE INVENTION

The aforementioned need is met by providing a method for measuring dimensions of a stack of medium in a media input location of an imaging system that includes emitting light along a direction that is at a predetermined angle with respect to the normal of the planar surface of the media input location. An array of photosensors are disposed along an array direction that lies in a plane defined by the direction of the light and the normal of the planar surface. The photosensors receive a spatially-varying pattern of light reflected from a surface that is substantially parallel to the planar surface of the media input location to provide corresponding electronic signal data from the photosensor array for subsequent transmission to a printing system controller. The varying electronic signal data is used to provide a measurement of the one or more dimensions corresponding to the stack of medium.

DETAILED DESCRIPTION OF THE INVENTION

Figure 1:
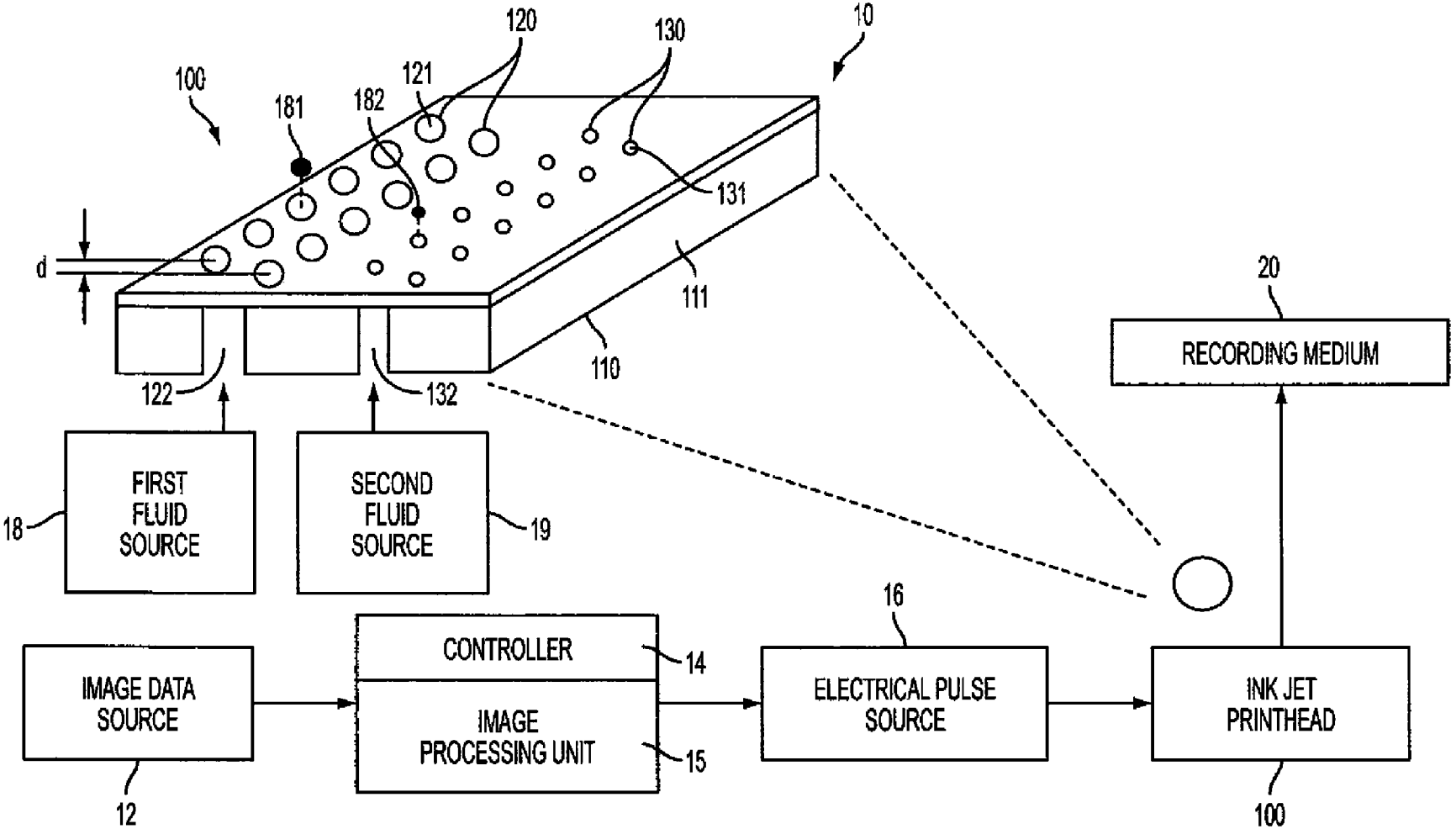
FIG. 1 is a schematic representation of an inkjet printer system.

Referring to FIG. 1, a schematic representation of an inkjet printer system 10 is shown, for its usefulness with the present invention and is fully described in U.S. Pat. No. 7,350,902, and is incorporated by reference herein in its entirety. Inkjet printer system 10 includes an image data source 12, which provides data signals that are interpreted by a controller 14 as being commands to eject drops. Controller 14 includes an image processing unit 15 for rendering images for printing, and outputs signals to an electrical pulse source 16 of electrical energy pulses that are inputted to an inkjet printhead 100, which includes at least one inkjet printhead die 110.

In the example shown in FIG. 1, there are two nozzle arrays. Nozzles in the first array 121 in the first nozzle array 120 have a larger opening area than nozzles in the second array 131 in the second nozzle array 130. In this example, each of the two nozzle arrays has two staggered rows of nozzles, each row having a nozzle density of 600 per inch. The effective nozzle density then in each array is 1200 per inch. If pixels on the recording medium 20 were sequentially numbered along the paper advance direction, the nozzles from one row of an array would print the odd numbered pixels, while the nozzles from the other row of the array would print the even numbered pixels.

In fluid communication with each nozzle array is a corresponding ink delivery pathway. Ink delivery pathway 122 is in fluid communication with the first nozzle array 120, and ink delivery pathway 132 is in fluid communication with the second nozzle array 130. Portions of fluid delivery pathways 122 and 132 are shown in FIG. 1 as openings through printhead die substrate 111. One or more inkjet printhead die 110 will be included in inkjet printhead 100, but for greater clarity only one inkjet printhead die 110 is shown in FIG. 1. The printhead die are arranged on a support member as discussed below relative to FIG. 2. In FIG. 1, first fluid source 18 supplies ink to first nozzle array 120 via ink delivery pathway 122, and second fluid source 19 supplies ink to second nozzle array 130 via ink delivery pathway 132. Although distinct fluid sources 18 and 19 are shown, in some applications it may be beneficial to have a single fluid source supplying ink to nozzle the first nozzle array 120 and the second nozzle array 130 via ink delivery pathways 122 and 132 respectively. Also, in some embodiments, fewer than two or more than two nozzle arrays may be included on printhead die 110. In some embodiments, all nozzles on inkjet printhead die 110 may be the same size, rather than having multiple sized nozzles on inkjet printhead die 110.

Not shown in FIG. 1, are the drop forming mechanisms associated with the nozzles. Drop forming mechanisms can be of a variety of types, some of which include a heating element to vaporize a portion of ink and thereby cause ejection of a droplet, or a piezoelectric transducer to constrict the volume of a fluid chamber and thereby cause ejection, or an actuator which is made to move (for example, by heating a bi-layer element) and thereby cause ejection. In any case, electrical pulses from electrical pulse source 16 are sent to the various drop ejectors according to the desired deposition pattern. In the example of FIG. 1, droplets 181 ejected from the first nozzle array 120 are larger than droplets 182 ejected from the second nozzle array 130, due to the larger nozzle opening area. Typically other aspects of the drop forming mechanisms (not shown) associated respectively with nozzle arrays 120 and 130 are also sized differently in order to optimize the drop ejection process for the different sized drops. During operation, droplets of ink are deposited on a recording medium 20.

Figure 2:
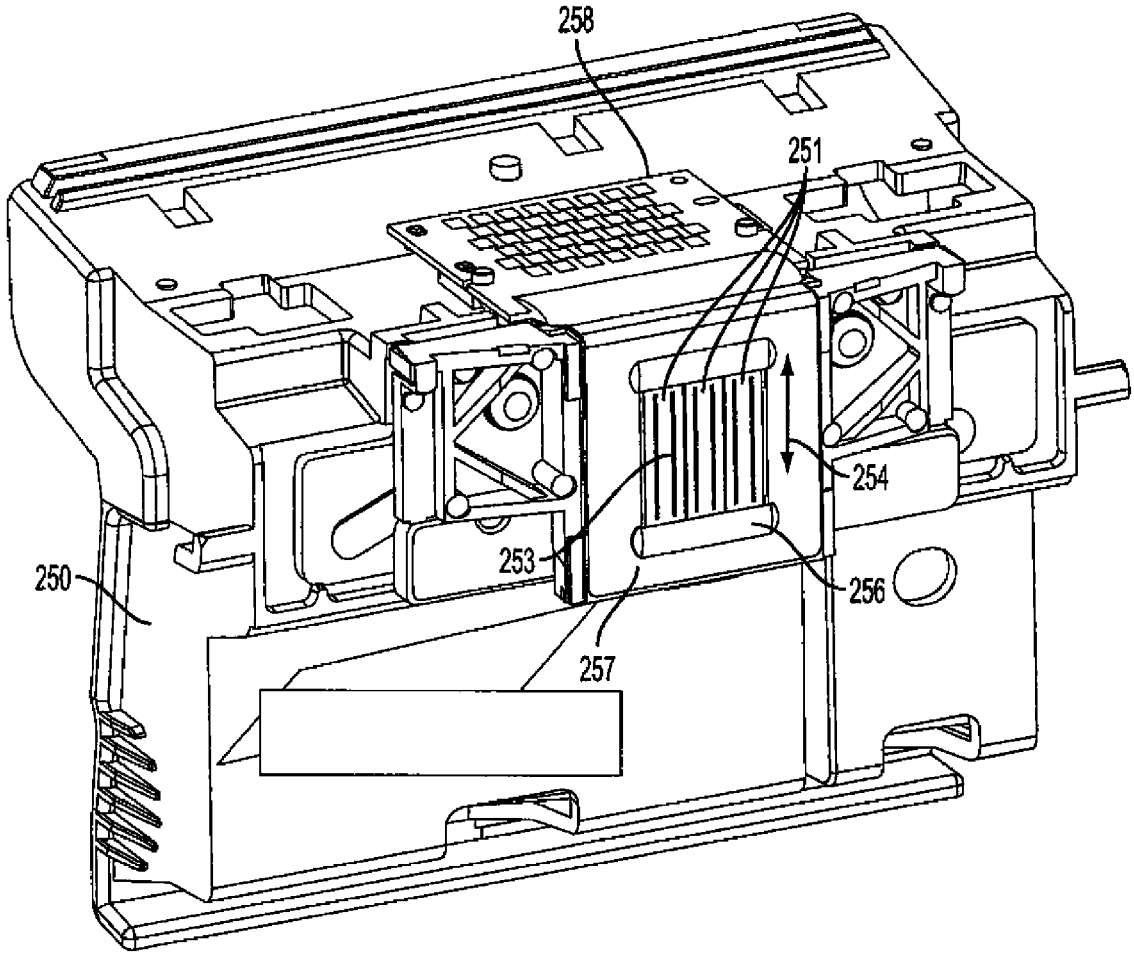
FIG. 2 is a perspective view of a portion of a printhead chassis.

FIG. 2 shows a perspective view of a portion of a printhead chassis 250, which is an example of an inkjet printhead 100. Printhead chassis 250 includes three printhead die 251 (similar to printhead die 110), each printhead die 251 containing two nozzle arrays 253, so that printhead chassis 250 contains six nozzle arrays 253 altogether. The six nozzle arrays 253 in this example may be each connected to separate ink sources (not shown in FIG. 2); such as cyan, magenta, yellow, text black, photo black, and a colorless protective printing fluid.

Each of the six nozzle arrays 253 is disposed along nozzle array direction 254, and the length of each nozzle array along direction 254 is typically on the order of 1 inch or less. Typical lengths of recording media are 6 inches for photographic prints (4 inches by 6 inches) or 11 inches for paper (8.5 by 11 inches). Thus, in order to print the full image, a number of swaths are successively printed while moving printhead chassis 250 across the recording medium 20. Following the printing of a swath, the recording medium 20 is advanced along a media advance direction 304 that is substantially parallel to nozzle array direction 254.

Also shown in FIG. 2 is a flex circuit 257 to which the printhead die 251 are electrically interconnected, for example, by wire bonding or TAB bonding. The interconnections are covered by an encapsulant 256 to protect them. Flex circuit 257 bends around the side of printhead chassis 250 and connects to connector board 258. When printhead chassis 250 is mounted into the carriage 200 (see FIG. 3), connector board 258 is electrically connected to a connector (not shown) on the carriage 200, so that electrical signals may be transmitted to the printhead die 251.

Figure 3:
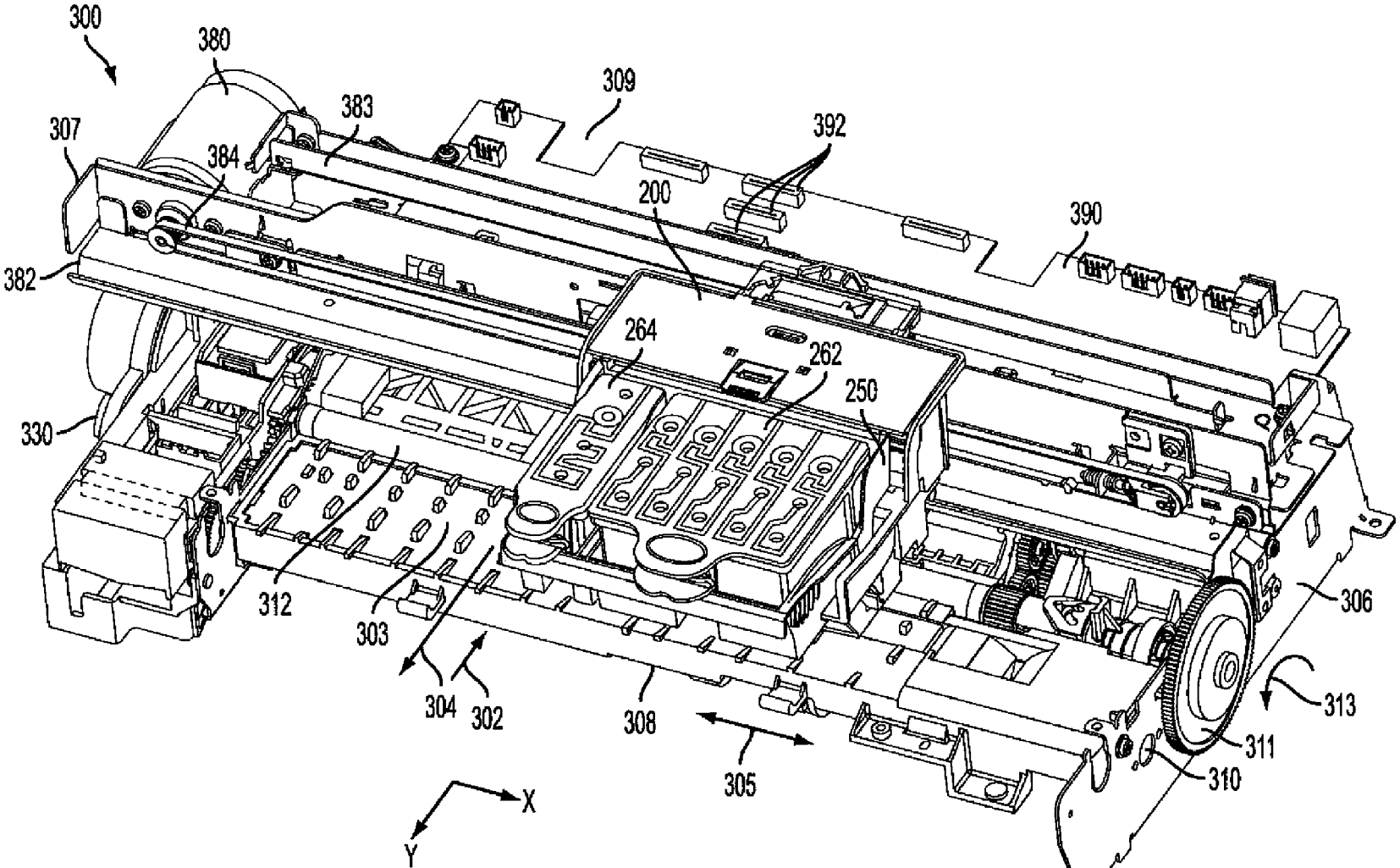
FIG. 3 is a perspective view of a portion of a carriage printer.

FIG. 3 shows a portion of a desktop carriage printer. Some of the parts of the printer have been hidden in the view shown in FIG. 3 so that other parts may be more clearly seen. Printer chassis 300 has a print region 303 across which carriage 200 is moved back and forth in carriage scan direction 305 along the X axis, between the right side 306 and the left side 307 of printer chassis 300, while drops are ejected from printhead die 251 on printhead chassis 250 that is mounted on carriage 200. Carriage motor 380 moves belt 384 to move carriage 200 along carriage guide rail 382. An encoder sensor (not shown) is mounted on carriage 200 and indicates carriage location relative to an encoder fence 383.

Printhead chassis 250 is mounted in carriage 200, and multi-chamber ink supply 262 and single-chamber ink supply 264 are mounted in the printhead chassis 250. The mounting orientation of printhead chassis 250 is rotated relative to the view in FIG. 2, so that the printhead die 251 are located at the bottom side of printhead chassis 250, the droplets of ink being ejected downward onto the recording medium in print region 303 in the view of FIG. 3. Multi-chamber ink supply 262, in this example, contains five ink sources: cyan, magenta, yellow, photo black, and colorless protective fluid; while single-chamber ink supply 264 contains the ink source for text black. Paper or other recording medium (sometimes generically referred to as paper or media herein) is loaded along paper load entry direction 302 toward the front of printer chassis 308.

Figure 4:
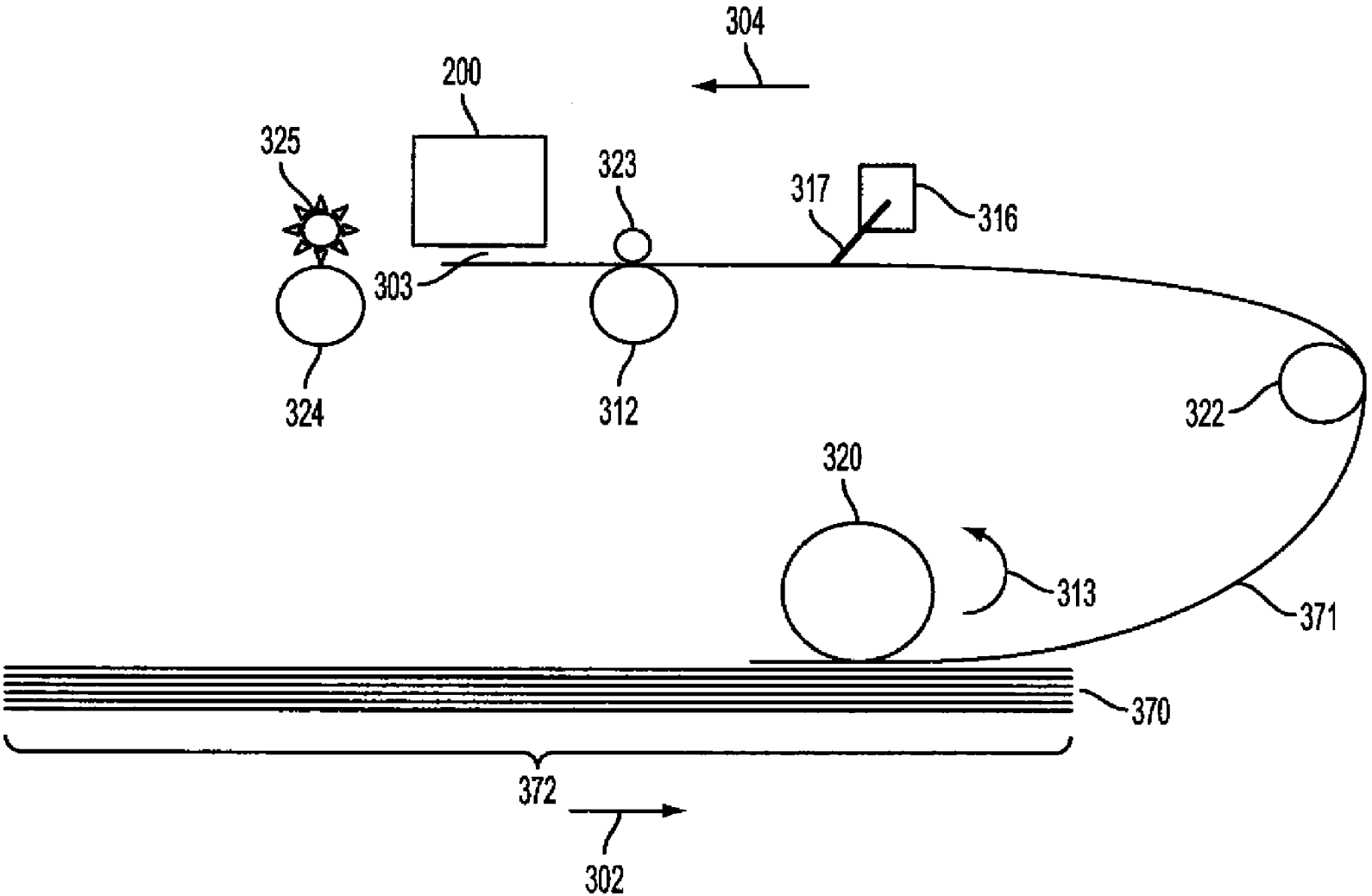
FIG. 4 is a schematic side view of an exemplary paper path in a carriage printer.

A variety of rollers are used to advance the medium through the printer as shown schematically in the side view of FIG. 4. In this example, a pick-up roller 320 moves the top piece or sheet 371 of a stack 370 of paper or other recording medium from the media input location 372 in the direction of arrow, paper load entry direction 302. The media input location can be an input tray, for example. A turn roller 322 acts to move the paper around a C-shaped path (in cooperation with a curved rear wall surface) so that the paper continues to advance along media advance direction 304 from the rear 309 of the printer chassis (with reference also to FIG. 3). Optionally a lead edge sensor 316 is positioned near feed roller 312. Lead edge sensor 316 can have an arm 317 that is moved as top piece of medium 371 goes past. Arm 317 can rotate a flag (not shown) to change the amount of light hitting a photodetector (not shown) in order to send a signal to printer system controller 14 that the top piece of medium 371 is entering the location of feed roller 312. The paper is then moved by feed roller 312 and idler roller(s) 323 to advance along the Y axis across print region 303, and from there to a discharge roller 324 and star wheel(s) 325 so that printed paper exits along media advance direction 304. Feed roller 312 includes a feed roller shaft along its axis, and feed roller gear 311 is mounted on the feed roller shaft. Feed roller 312 can include a separate roller mounted on the feed roller shaft, or can include a thin high friction coating on the feed roller shaft. A rotary encoder (not shown) can be coaxially mounted on the feed roller shaft in order to monitor the angular rotation of the feed roller.

The motor that powers the paper advance rollers is not shown in FIG. 1, but the hole 310 at the right side of the printer chassis 306 is where the motor gear (not shown) protrudes through in order to engage feed roller gear 311, as well as the gear for the discharge roller (not shown). For normal paper pick-up and feeding, it is desired that all rollers rotate in forward rotation direction 313. Toward the left side of the printer chassis 307, in the example of FIG. 3, is the maintenance station 330.

Toward the rear of the printer chassis 309, in this example, is located the electronics board 390, which includes cable connectors 392 for communicating via cables (not shown) to the printhead carriage 200 and from there to the printhead chassis 250. Also on the electronics board are typically mounted motor controllers for the carriage motor 380 and for the paper advance motor, a processor and/or other control electronics (shown schematically as controller 14 and image processing unit 15 in FIG. 1) for controlling the printing process, and an optional connector for a cable to a host computer.

For the C-shaped paper path shown in FIG. 4 the stack of media 370 is loaded backside facing up at media input location 372. The backside of the medium is the side of the sheet that is not intended for printing. Specialty media having glossy, luster, or matte finishes (for example) for different quality media may be marked on the backside by the media manufacturer to identify the media type.

Embodiments of the present application use a linear array of photosensors to produce electronic signals that vary in amplitude among the photosensors in the array, corresponding to the position and amplitude of a beam of light that has been reflected from a piece of medium (e.g. top piece of medium 371) in the media input location 372. The position of a peak of the electronic signal (or a position of the centroid of the peak) provides a measurement of the height of the stack of media. Shifts in the position of the peak in the electronic signal provide a measurement of additional dimensions of the stack of recording medium, such as the thickness and length of the piece of recording medium that has previously been advanced, or a change of stack height that can be related to the inadvertent feeding of multiple pieces of medium. Changes in the shape or amplitude of the peak can furthermore be related to manufacturer's markings on the medium, in order to identify the type of recording medium that is present in the media input location.

Figure 5:
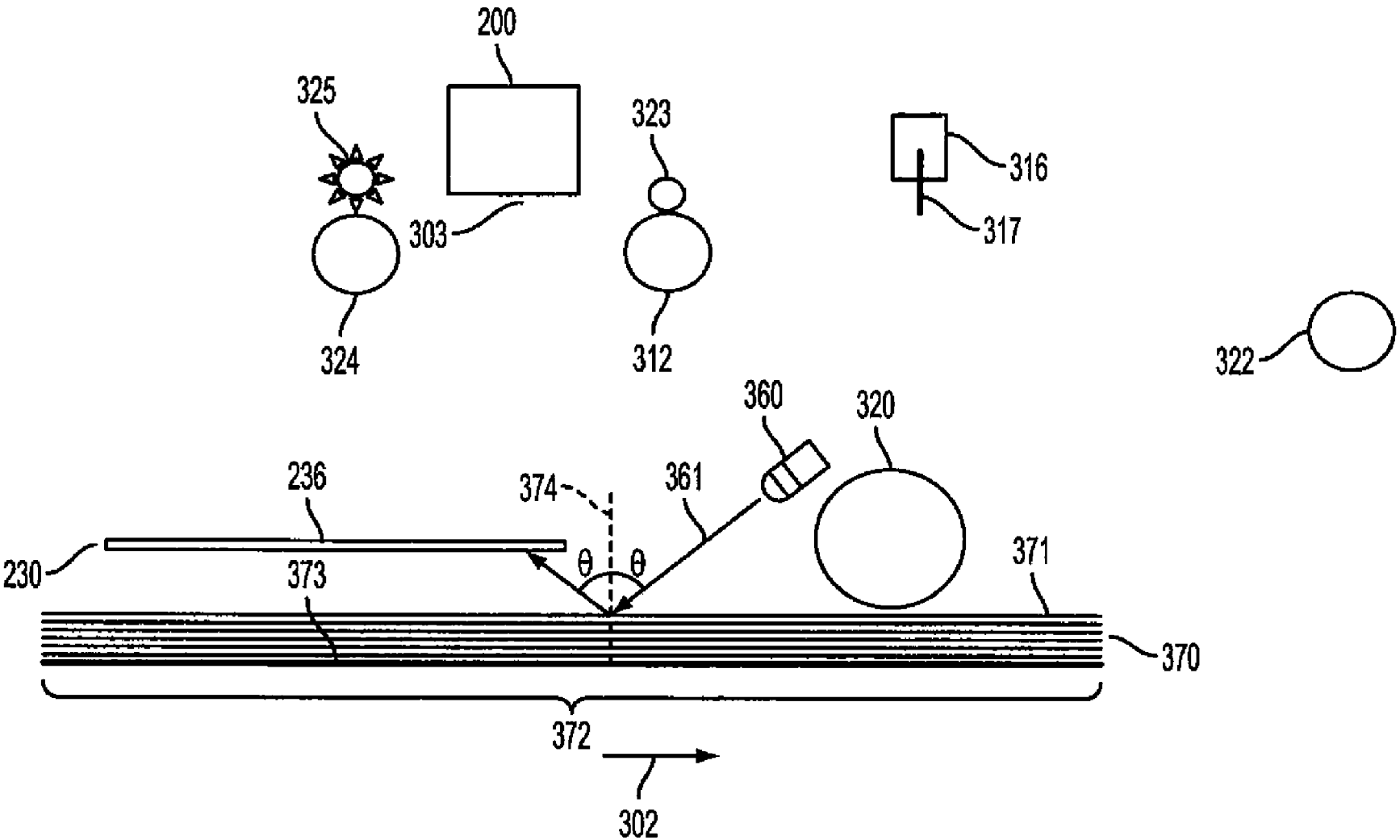
FIG. 5 shows a schematic side view of an embodiment of the present invention.

FIG. 5 shows the same view as in FIG. 4, but the top piece of medium 371 is still at media input location 372. (Note that arm 317 on lead edge sensor 316 is in its down position, since top piece of medium 371 has not moved arm 317.) Media input location 372 includes a planar surface 373, such as a shelf or the bottom of an input tray. Dashed line, normal 374, represents the normal to the planar surface 373. Recording medium stacked on the planar surface 373 is substantially parallel to planar surface 373; so dashed line, normal 374, also represents the normal to the surface of the top piece of medium 371. A light source 360 such as an LED or a laser diode emits a beam of light 361 toward the planar surface 373 of media input location the top piece of medium 371. Light beam 361 is emitted at a predetermined angle θ with respect to the normal 374. If one or more pieces of media is located at media input location 372, the light beam 361 will be reflected from the top piece of medium 371. Preferably the emitted light beam 361 is a narrow, collimated beam, such that the beam has an incident width in the range of about 0.5 mm to 5 mm (for 50 percent intensity cut-off points) where it impinges on either the top piece of medium 371 or on the planar surface 373, if no medium is present. Collimation of the light can be provided by lenses, mirrors, apertures or attenuators such that light rays that reach the top piece of medium 371 are substantially incident at the predetermined angle θ with respect to the normal 374. Both specular reflection and diffuse reflection of light from top piece of medium 371 will occur. Spectrally reflected beam of light beam 361 leaves the top piece of medium 371 (or the planar surface 373, if no media is present) at an angle equal to the predetermined angle θ with respect to the normal 374, as shown in FIG. 5. Diffusely scattered light causes the reflected light beam to broaden, relative to its incident width, as represented in the examples shown in FIGS. 6*a*, 6*b*, and 6*c* discussed below.

A linear array of photosensor array 230 is positioned substantially parallel to planar surface 373 and is located above the top piece of medium 371. Linear array of photosensor array 230 typically includes one hundred to one thousand or more photosensors 236 that are spaced apart from one another by a distance d. However, linear photosensor arrays having fewer photosensors (e.g. ~10) can also be used. The number of photosensors and the array resolution are related to the sensitivity and range of measurements that can be made in embodiments of this invention. A typical spacing d is 0.00167 inch, corresponding to an array resolution of 600 photosensors per inch, but linear photosensor arrays having other resolutions can alternatively be used. In order to receive the specular reflection of emitted light beam 361, the linear photosensor array should be oriented within the plane defined by the direction of the emitted light beam 361 and the normal 374 to planar surface 373. A further alignment that linear photosensor array 230 be substantially parallel to planar surface 373 provides one preferable orientation of the linear photosensor. The height of linear photosensor array 230 above planar surface 373 is such that linear photosensor array 230 is higher than the top piece of medium 371 when the stack of media 370 is at its full height.

In the example shown in FIG. 5, the direction of emitted light beam 361 and the linear photosensor array 230 are oriented such that linear photosensor array 230 is substantially parallel to direction 302 along which top piece of medium 371 is fed from media input location 372. However, in other embodiments, emitted light beam 361 and linear photosensor array 230 can be oriented at other angles, for example with linear photosensor array 230 substantially perpendicular to paper load entry direction 302.

Although the word "light" is used herein, the term is not meant to exclude wavelengths outside the visible spectrum. In some embodiments, infrared illumination is used, for example. The photosensors 236 in the linear photosensor array 230 should be sensitive to the wavelength of light coming from the medium. For embodiments where light source 360 is an infrared light source, an infrared linear photosensor array 230 is contemplated.

Figure 6A:
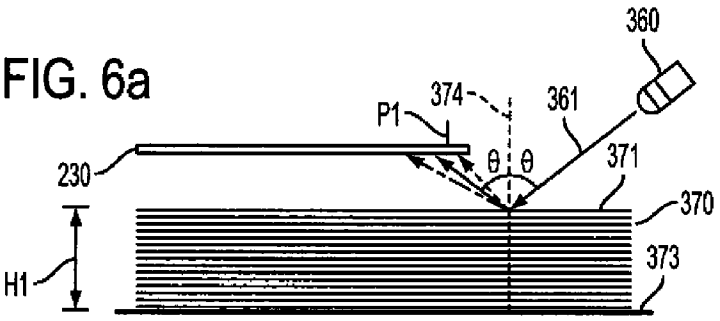
FIGS. 6*a*, 6*b*, and 6*c* show schematic side views of an embodiment of the present invention for a variety of media stack heights.
Figure 6B:
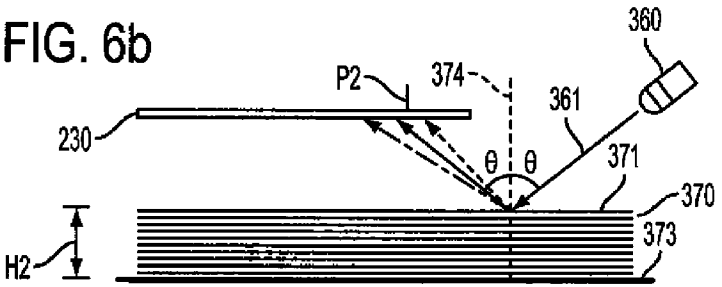
Figure 6C:
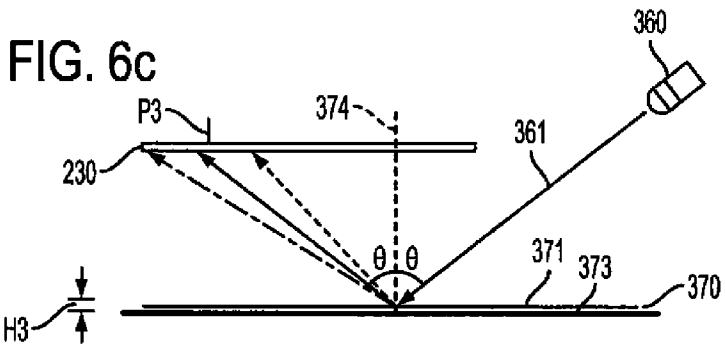
Figure 6D:
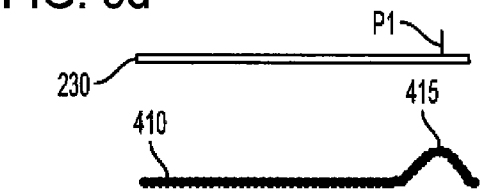
FIGS. 6*d*, 6*e*, and 6*f* schematically show output signals from a linear photosensor array corresponding to stack heights in FIGS. 6*a*, 6*b*, and 6*c* respectively.

FIGS. 6*a*, 6*b*, and 6*c* show portions of side views similar to FIG. 5, but with three different media stack heights. In FIG. 6*a*, the media stack height H1 represents a full media stack. Emitted light beam 361 reflects from top piece of medium 371, both spectrally (represented by the solid arrow at angle θ with respect to the normal 374), and also diffusely (represented by the dashed arrows oriented at angles less than and greater than θ). The specular reflection has the greatest intensity of light and the diffuse light is incrementally less intense at angles further from θ. The electronic output signal of a photosensor is larger when more light is received, so that a spatially-varying photosensor array output signal 410 is provided as shown schematically in corresponding FIG. 6*d*. A peak in intensity of light occurs at P1 where light is reflected spectrally. Correspondingly, photosensor array output signal 410 has a peak 415 whose maximum amplitude is located substantially at the photosensor corresponding to location P1. Noise in the measurement can cause peak 415 to deviate slightly from location P1. Rather than identifying the maximum photosensor reading as the location of the peak of the signal, the centroid of the peak can be used as described below relative to signal analysis.

Figure 6E:
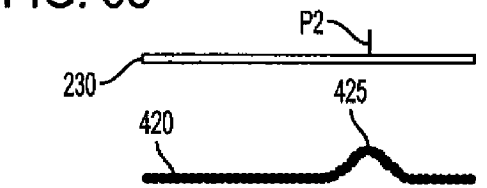

Similarly, FIG. 6*b* represents a partially depleted stack of media having a height H2 which is less than H1. As a result, incident light beam 361 travels a further distance until it hits top piece of medium 371. Reflected light also travels a longer distance from top piece of medium 371 to linear photosensor array 230. As a result, the location of the spectrally reflected light moves to a new location P2 on the linear photosensor array 230. FIG. 6*e* schematically shows the corresponding photosensor array output signal 420. Peak 425 in the electronic output signal 420 is shifted to a photosensor site corresponding to light intensity peak P2. It can be shown that the distance ΔS that the spectrally reflected beam of light moves as a function of change of stack height ΔH is given by:

$$\Delta S = 2\Delta H \tan\theta \qquad \text{(Equation 1)}$$

As the stack height changes from H1 to H2, the distance that the peak moves is given by (P1−P2)=2(H1−H2) tan θ according to Equation 1. If θ=45 degrees, for example, this gives (P1−P2)=2(H1−H2). As θ increases, the amount of peak shift increases. If θ=60 degrees, (P1−P2)=3.46 (H1−H2).

The distance that the peak shifts as a function of change in stack height, is important both for the sensitivity of the measurement of stack height, and also for the required length of the linear photosensor array 230. The thickness of a single piece of plain paper is about 0.003 inch. Thus, if θ=45 degrees, the distance the peak will move if a single piece of plain paper is removed from the stack is ΔS=2 ΔH=0.006 inch. If the photosensors 236 on linear photosensor array 230 are at a resolution of 600 per inch (i.e. are spaced apart by d=0.00167 inch), this is equivalent to a peak shift by between 3 and 4 photosensor spacings. On the other hand, if 0=60 degrees, then the distance the peak moves, if a single piece of paper is removed from the stack is ΔS=3.46 ΔH=0.0104 inch, which is equivalent to a peak shift by just over 6 photosensor spacings. Thus, a 600 per inch resolution linear photosensor array 230 provides adequate sensitivity to detect a single piece of plain paper being removed from the stack. In addition, the thickness of a single piece of inkjet photo media typically ranges between 0.006 and 0.012 inch (i.e. about 2 times to 4 times the thickness of a piece of plain paper), so removal of one piece of photo media is even easier to detect by the peak shift.

FIG. 6*c* represents the case of only a single piece of medium (top piece of medium 371) remaining in the stack of media 370. If the difference between a full stack height and a nearly depleted stack height is H1−H3=0.5 inch, for example, then if θ=45 degrees, the distance the peak will shift is ΔS=2 ΔH=1 inch. To accommodate peak broadening by diffuse scattering, it is preferred in this example that the linear photosensor array 230 be longer than 1 inch in order to detect the peak shift for the full range of stack heights. If the full stack height is 0.5 inch but 0=60 degrees, then ΔS=3.46 ΔH=1.73 inches, it is preferred that the linear photosensor array 230 be about 2 inches long.

Figure 6F:
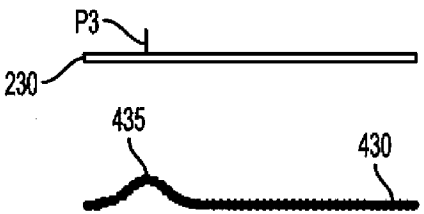

In addition to the shift in the location of the peak as the stack height changes, the width of the peak also changes. Comparing FIGS. 6*a*, 6*b*, and 6*c* shows one reason for peak width changes. Assuming the range of angles of diffuse scattering from the top piece of medium 371 is constant, then the shorter the stack height, the farther the top piece of medium 371 is from linear photosensor array 230, and the more the peak broadens. If the emitted light beam 361 is not well collimated, the incident beam width also increases as the stack height gets shorter, leading to further peak broadening and a decrease in peak amplitude. A moderate amount of peak broadening is shown from FIG. 6*d* to FIG. 6*f* (i.e. peak 435 of output signal 430 is broader than peak 415 of output signal 410) as the stack height decreases, but these schematic representations of peak shape are not meant to be precise representations. In addition to the effect of stack height on peak width, the peak width is also dependent upon the incident angle of the emitted light beam 361. The width of incident light beam 361 where it hits top piece of medium 371 increases for larger values of θ, leading to wider peaks.

Figure 7:
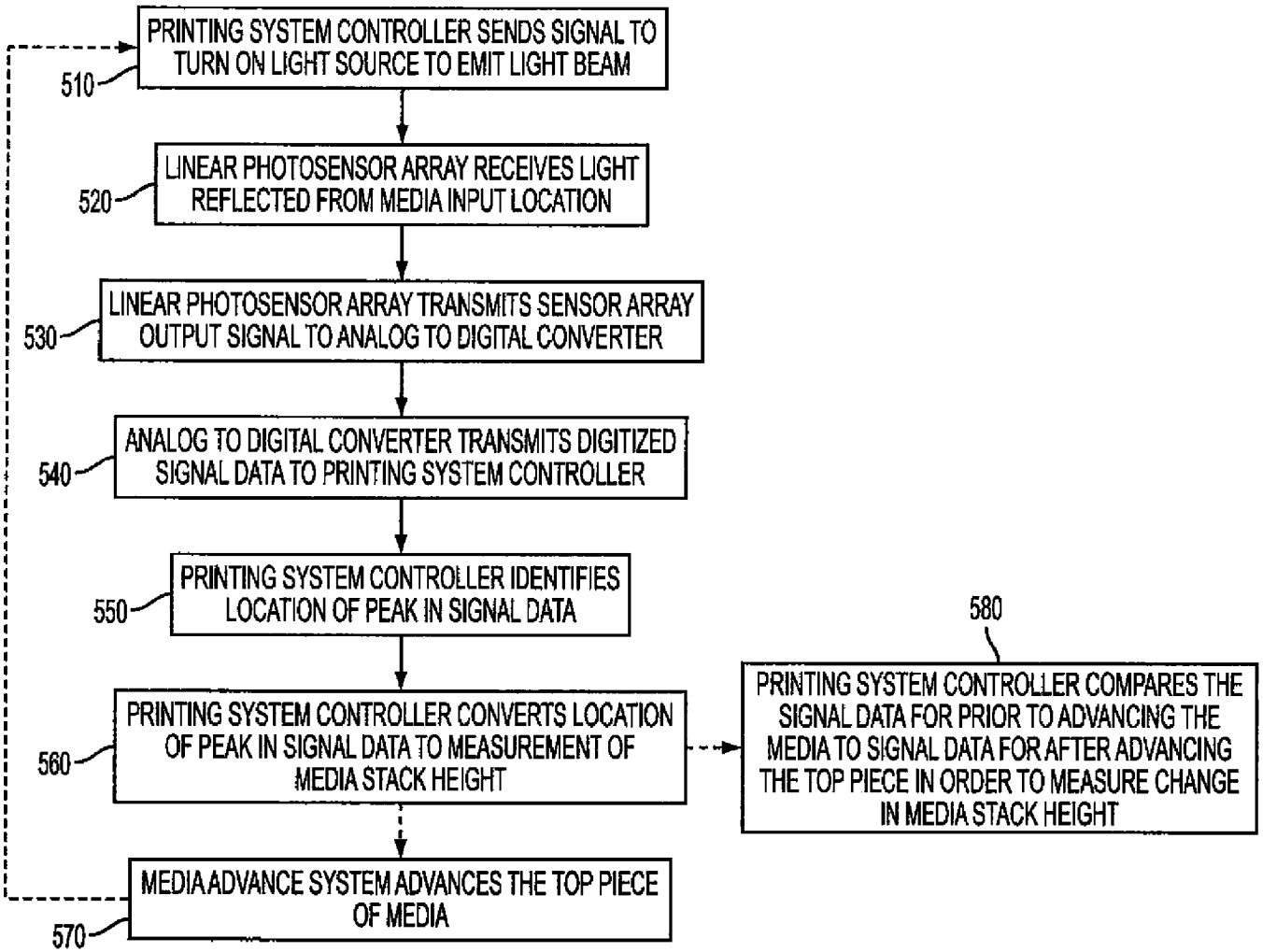
FIG. 7 shows a flow chart of an embodiment of the present invention for measuring stack height or a change in stack height.

FIG. 7 shows a flow chart of an embodiment for measuring the height of stack of media 370. In step 510, printing system controller 14 sends a signal to turn on light source 360 to emit a light beam 361 toward media input location 372. The terminology "light beam" 361, is used herein to refer to any light beam emitted from light source 360 toward media input location. It is recognized that a different group of photons is incident on media input location 372 at different times, whether or not light source 360 is turned on and off. For clarity, rather than referring to these different groups of photons as different light beams, we refer herein to a single light beam that may be emitted at different times. The trigger for printing system controller 14 to send the signal to turn on light source 360 can be the advancing of a previous piece of medium, or turning the printing system on, or an elapsed time on a clock, for example.

Emitted light beam 361 is incident on media input location 372. If a stack of media 370 is present at media input location 372, then emitted light beam 361 impinges on top piece of medium 371. If there is no medium present at media input location 372, then emitted light beam 361 impinges on planar surface 373, or optionally on a feature (not shown) provided at the predetermined incident beam location at planar surface 373 (the predetermined incident beam location being related to predetermined angle θ at which light beam 361 is emitted). The feature on planar surface 373 can be a hole, a light deflector, a scattering surface or a light absorber for example. The purpose of the optional feature is to provide a dramatic change in the subsequent signal produced by linear photosensor array 230, to provide an unmistakable indication that there is no medium present at media input location 372. If the feature is a hole or a light absorber, for example, the height of the peak signal of the linear photosensor array 230 decreases dramatically. If the feature is a light deflector, for example, the position of the peak shifts dramatically. If the surface of the feature is roughened for increased scattering, the peak decreases, but the signal at the other photosites increases.

At step 520, the linear photosensor array 230 receives light reflected from the media input location 372. (If no medium is present and the optional feature in the planar surface 373 is a hole as described above, substantially no light is reflected, but this is considered as a special case of step 520.) At step 530 linear photosensor array 230 produces a photosensor array output electronic signal, and this output electronic signal is transmitted to an analog to digital (A/D) converter. Optionally, prior to transmitting the output signal to the A/D converter, the output signal can be amplified and/or processed to remove some of the signal noise. At step 540, the A/D converter converts the output signal to digitized signal data and transmits the digitized signal data to the printing system controller 14.

At step 550, printing system controller 14 identifies the location of the peak in the signal data. This step identifies the location at which the signal data is at the largest value in the set of data points. Alternatively, this step can include first setting a baseline value, by selecting a set of data points relative to a predetermined threshold value and averaging the values of this set. The peak can then be identified, for example, by a) subtracting the baseline value from each data point, b) summing adjacent groupings (e.g., data from groups of thirty adjacent photosensors 236) of the subtracted data points, c) identifying the grouping whose sum is greatest, and d) identifying the peak location as being the midpoint of the grouping of photosensors. Alternatively, the centroid of the peak can be identified by dividing the sum by two and noting the location at which half the sum of the grouping is attributed to data from photosensors to one side of the location, and the other half of the sum of the grouping is attributed to data from photosensors to the other side of the location.

After identifying the peak location, the printing system controller 14 can store the peak location in memory. At step 560, the printing system controller converts the location of the peak to a measurement of the media stack height. When measuring the media stack height, the predetermined angle θ of the emitted light beam 361 is fixed, so that tan θ has a constant value C that is stored in memory. If the peak location corresponding to full stack height H1 is the known location P1 (where both H1 and P1 are stored in memory), then from Equation 1, the variable stack height H2 corresponding to variable peak location P2 is given by the formula H2=H1−(P2−P1)/2C.

The dashed arrows in FIG. 7 indicate additional steps that can be performed in order to measure a change of height of the stack of media after a piece of medium has been advanced by the media advance system. Let the stack height, before advancing the piece of medium, be H4, corresponding to a peak location P4. At step 570 the media advance system advances the top piece of medium 371 in stack of media 370. Then steps 510 through 560 are repeated to provide a new stack height H5 corresponding to a new peak location P5. Then at step 580, the printing system controller 14 compares the signal data that was provided by linear photosensor array 230 before advancing the top piece of medium 371 to signal data that was provided by linear photosensor array 230 after advancing top piece 371. In particular, the change in stack height is given by (P4−P5)/2C. Equivalently, rather than comparing peak locations directly, the controller 14 could subtract the newly measured stack height H5 from the previously measured stack height H4.

A change in media stack height after advancing top piece of medium 371 can be interpreted as being equal to the thickness of the top piece of medium 371 in some circumstances. In other circumstances, the change in media stack height can be interpreted as the inadvertent feeding multiple pieces of medium. Generally a stack of the same type of medium is loaded into the media input location. Therefore, if the shift in the peak signal, along the photosensor array, is similar to the previous peak signal shift corresponding to advancing the previous piece of medium, it can be assumed that the change in media stack height probably corresponds to the thickness of the piece of medium. On the other hand, if the shift in the peak signal is twice or more than twice the previous peak signal shift, there is a good chance that two or more pieces have been fed at the same time. In some circumstances, the printing system controller 14 already knows the thickness of the medium, because the user has specified a medium type having a known thickness, or because manufacturer's code markings have identified a medium thickness. In such cases, if the measured change of height is an integral multiple of the known thickness of the medium, it is known that multiple pieces of medium have been fed. A further way of sensing the misfeeding of multiple pieces is to make several measurements of stack height during paper feeding. The trail edges of pieces may not line up resulting in several peak shifts, instead of a single shift in the location of the peak.

Many printing systems include a media separating mechanism, such as a friction buckler (not shown), to reduce the occurrences of misfeeds of several pieces of medium at once. In such cases, one or more pieces of medium may stick to the top piece of medium 371 when pick-up roller 320 first starts advancing top piece of medium 371, but once the lead edge of top piece of medium 371 hits the media separating mechanism, it is allowed to continue moving, while the other pieces are left behind. In such embodiments, it is important to reliably interpret change of media stack height as feeding of multiple pieces, the detection should be done in a location of the trail edge of the top piece of medium 371 that corresponds to the lead edge having already hit the media separating mechanism.

If a larger change of height is detected than the expected thickness of a single piece of medium, the printing system controller 14 can be programmed to stop the print job and notify the user. This is especially true if the measured change in stack height is so great that such a quantity of medium would likely cause a jam and perhaps strike the printhead. Optionally, for noncritical instances of feeding of multiple pieces of medium, the printing system controller 14 can send a signal to the media advance system to adjust the rotational advance of the feed roller 312 in order to compensate the media advance for the increased thickness. In that way, the printed piece would have the appropriate media advance amount between swaths, and the user would simply need to remove blank pieces from the print job after printing is complete.

Figure 8:
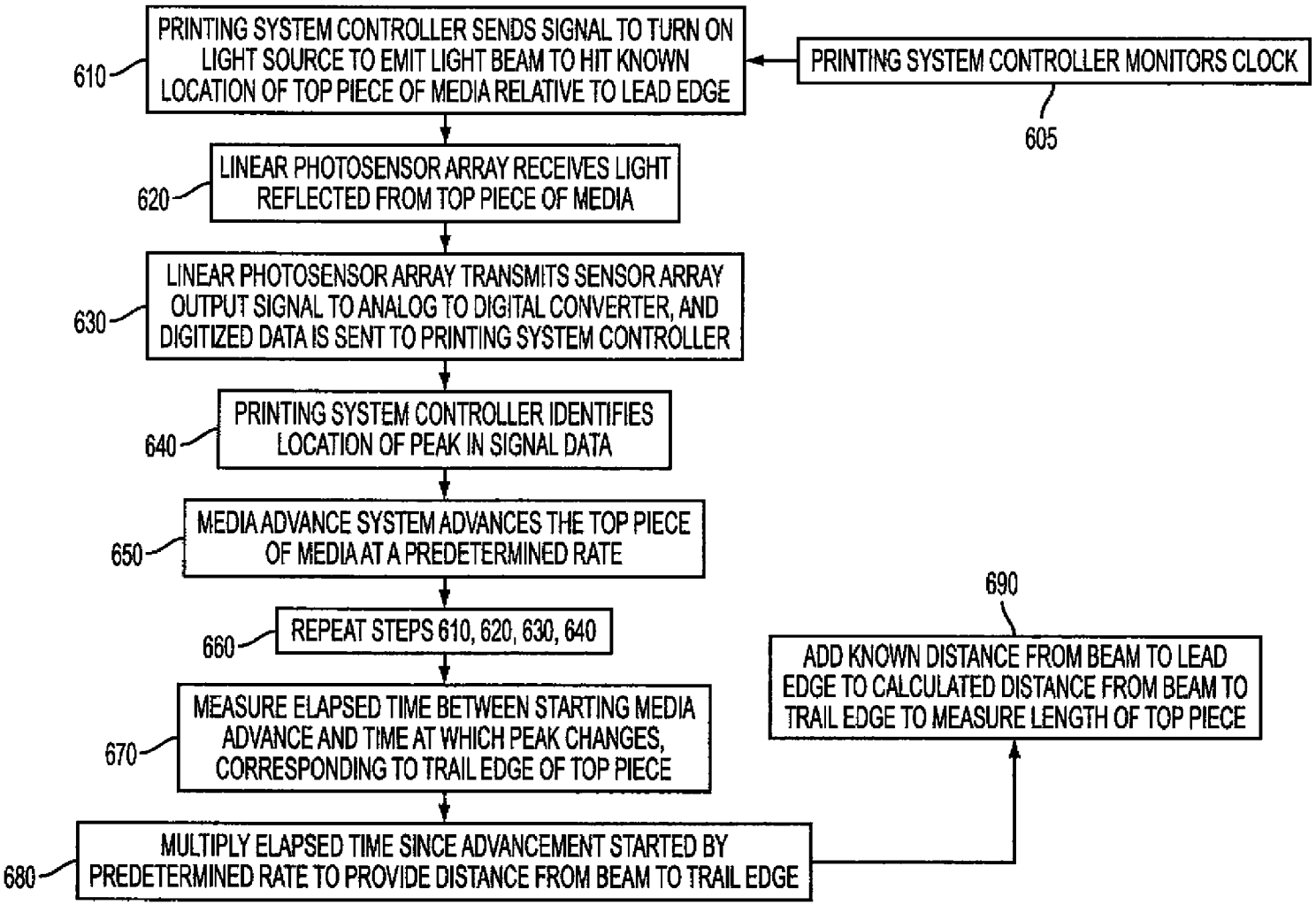
FIG. 8 shows a flow chart of an embodiment of the present invention for measuring a length of a piece of medium.

FIG. 8 shows a flow chart for measuring a length of the top piece of medium 371 that is being advanced. Measuring the length of the top piece of medium 371 enables length measurement of individual sheets in stack of media 370, rather than assuming all sheets have the same length. In the embodiment described in FIG. 8, the printing system controller 14 includes a clock. In addition, the media advance system is controllable to advance a piece of medium at a substantially constant predetermined rate, for example by rotating pick-up roller 320 or feed roller 312 at a predetermined angular velocity. In step 605, printing system controller 14 begins monitoring the clock. In step 610 (which may begin either before, together with, or after step 605), the printing system controller 14 sends a signal to turn on light source 360 to emit a light beam 361. Light beam 361 hits top piece of medium 371 at a known distance from the lead edge of top piece of medium 371, the known location of light beam 361 being related to a previous measurement of the media stack height. At step 620, linear photosensor array 230 receives light reflected from top piece of medium 371. At step 630 the linear photosensor array 230 transmits the output signal to an A/D converter and the digitized data is sent to printing system controller 14. At step 640, a peak can be located as described above, or a photosensor location can be identified as providing the largest signal data. This photosensor location or peak location (which is substantially equivalent) is predetermined by the present height of the stack of media 370 and the angle θ at which light beam 361 is emitted. Knowing the location of the peak is equivalent to knowing the location of emitted beam 361 where it is incident on top piece of medium 371. At step 650, media advance system, advances top piece of medium 371 at a predetermined rate. At step 660, steps 610, 620, 630, and 640 are repeated while the top piece of medium 371 is being advanced and the clock is continuously monitored. Step 660 is repeated until the peak location changes. At step 670, the elapsed time is measured between starting the media advance at a substantially constant predetermined rate and the change in location of the peak (corresponding to the trail edge of top piece of medium 371 passing the location of incident light beam 361 at media input location 372). At step 680, the elapsed time measured at step 670 is multiplied by the predetermined rate of media advancement relative to step 650 to provide a distance between the trail edge of top piece of medium 371 and the photosensor or peak location relative to step 640. At step 690, the distance calculated in step 680 is added to the known distance between lead edge of top piece of medium 371 and the photosensor or peak location in order to provide a measurement of the length of top piece of medium 371. Because the beam location where it is incident on top piece of medium 371 is known from the location of the peak in the signal of the data from linear photosensor array 230, this method is equivalent to knowing how far the lead edge is from the location of light beam 361 on top piece of medium 371, and then finding the distance of the location of beam 361 to the trail edge, by multiplying the rate of advancement of top piece of medium 371 by the elapsed time, until the trail edge passes the beam location.

In some embodiments relative to the flow chart of FIG. 8, the rotation of pick-up roller 320 at a constant angular velocity provides a substantially constant predetermined rate of advancement of top piece of medium 371. In such embodiments, the elapsed time measured by the clock can begin when the pick-up roller 320 begins to turn, and the distance from the lead edge to the incident beam 361 can be the distance from the lead edge to the light beam 361 before the pick-up roller 320 begins to turn.

In other embodiments relative to the flow chart of FIG. 8, the rotation of pick-up roller 320 is not used to provide substantially constant predetermined rate of advancement of top piece of medium 371. For example, in some systems, media slippage during picking can introduce too much variability. In such systems, the elapsed time measured by the clock can begin when or slightly after the lead edge of top piece of medium 371 hits arm 317 and trips lead edge sensor 316 (see FIGS. 4 and 5). The predetermined rate of advancement can be provided by advancing a stepper motor a certain number of steps per second, or by providing feedback from a rotary encoder coaxially mounted with feed roller 312. The known distance from the lead edge to the incident light beam 361 can be with reference to the position of arm 317 or of feed roller 312. In some of these embodiments, in order to deskew the top piece of medium 371 entering the nip of the feed roller 312 and idler roller 323, the feed roller 312 is initially rotated opposite the forward rotation direction 313 in order to properly orient the lead edge. Then the feed roller 312 is rotated in forward rotation direction 313 to advance the top piece of medium 371. In such cases, the elapsed time measured by the clock should begin when the feed roller 312 is instructed to turn in forward rotation direction 313, and the known distance from the lead edge to the incident beam 361 should be with reference to the nip of feed roller 312 and idler roller 323.

U.S. Pat. No. 7,055,925 discloses a carriage-mounted linear photosensor array (called a scanner sensor or CCD array) that may be used for several different functions in an inkjet printer. One function described with reference to FIG. 9 of '925 is the measurement of the spacing between the pen (i.e. the printhead) and the paper. Similar to the present invention, in '925 a light source is incident at an angle to the paper, and the location of the incidence of a direct reflection on the linear photosensor array is used to measure a distance, the distance being the pen to paper spacing in '925. An important difference between the present invention and the spacing measurement made in '925 is that in the present invention, rapid changes in a peak location in the output signal of the linear photosensor array are measured, thus enabling measurements such as the change of stack height or the length of a piece of medium as media is being advanced through the imaging system.

Figure 9B:
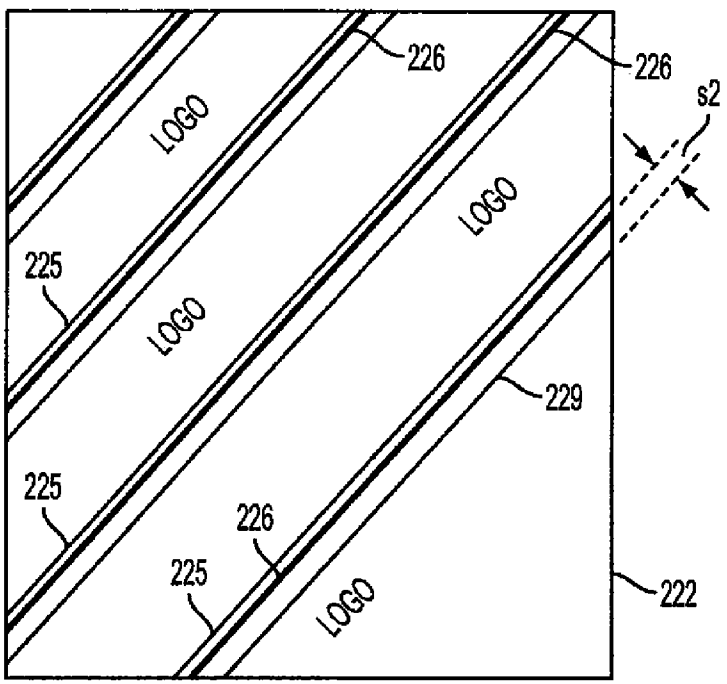
FIGS. 9*a* and 9*b* show schematic representation of markings on the backside of a first type of recording medium and a second type of recording medium respectively.
Figure 9A:
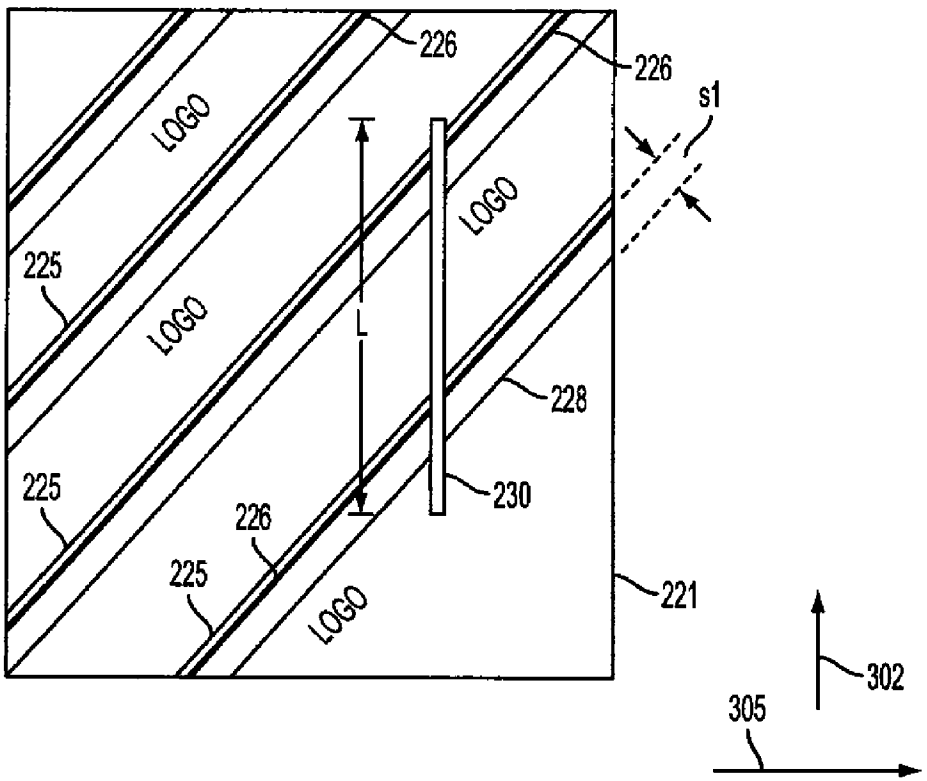

A further implementation of linear photosensor array 230 is the identification of the type or size of media, based on manufacturer's code markings on the media. FIGS. 9*a* and 9*b* show schematic representation of marking patterns on the backside of a first type recording medium 221 and a second type recording medium 222 respectively. In this example, the marking pattern of each of the various types of recording media has a reference marking consisting of a pair of "anchor bars" 225 and 226, which are located at a fixed distance with respect to one another for all media types. In addition, there is a first identification mark 228 on the first type recording medium 221 in FIG. 9*a*, and there is a second identification mark 229 on the second type recording medium 222 in FIG. 9*b*. In this example, first identification mark 228 is spaced a distance s1 away from second bar of anchor bars 226 on first type recording medium 221, and second identification mark 229 is spaced a distance s2 away from second bar of anchor bars 226 on second identification mark 229, such that s1 does not equal s2. Thus in this example, it is the spacing of the identification mark from one of the anchor bars that identifies the particular type of recording medium. The marking pattern is repeated several times on the backside of the recording medium. The marking pattern is oriented at a predetermined angle with respect to the sides of the recording medium, and the recording medium is oriented at the media input location with a side parallel to the direction 302 so that pieces of recording medium are advanced from media input location 372. In some embodiments, the linear photosensor array 230 is oriented perpendicular to the bars of the marking pattern in order to increase the signal to noise ratio of the measurement of the bars.

The top view of FIG. 9*a* shows linear photosensor array 230 extending along the paper load entry direction 302 that pieces of recording medium are advanced from the media input location. Unlike commonly assigned, co-pending, U.S. patent application Ser. No. 12/332,648; incorporated herein by reference, where an extended region of the piece of recording medium is illuminated and the linear photosensor array provides an output signal that varies among its photosensors corresponding to the markings; in the present invention, emitted light beam 361 is incident on a particular small region that is smaller than the marking pattern. Thus, in order to provide an output signal from linear photosensor array 230 to identify media type from manufacturer's code markings in the present invention, the emitted light beam 361 needs to be scanned across the surface of the piece of medium at a predetermined rate. As emitted light beam 361 crosses markings, such as 225, 226, and 228; sequentially received changes in the spatially-varying output signal from linear photosensor array 230 occur and can be transmitted to printing system controller 14 for measurement of distances of spacings or widths of bars that can be correlated using a reference look-up table to a specific type of media.

Incident light beam 361 can be scanned across top piece of medium 371 either by moving the light beam 361 or by moving the top piece of medium 371. In some embodiments, light source 360 is moved translationally in a direction parallel to linear photosensor array 230, such that incident light beam 361 moves across the top piece of medium 371. In these embodiments, light source 360 emits light beam 361 at predetermined angle θ and the spectrally reflected peak intensity is reflected at angle θ to linear photosensor array 230. The peak moves along linear photosensor array 230 as the incident light beam 361 moves across the top piece of medium 371. If the incident light beam 361 strikes an unmarked region of medium, the amplitude of the peak remains substantially constant. However, when the incident light beam 361, strikes an actual mark, the amplitude of the peak changes. A mark made with a light absorbing marking material causes the amplitude of the peak to decrease. Counting the number of photosensors that sequentially have a decreased peak amplitude, for example, provides a measurement of the width of a bar. Counting the number of photosensors where the peak is at full amplitude before the peak between dips in the peak provides a measurement of spacings between bars. Alternatively, measurement of the elapsed time between changes in amplitude and multiplying that elapsed time by the velocity of the light source 360 provides another measurement of spacings or widths of bars.

Other embodiments for translational scanning of the light beam 361 relative to the surface of top piece of medium 371 include moving the top piece of medium 371 or moving the media input location 372 that contains top piece of medium 371. For moving the top piece of medium 371 relative to the light beam 361, one can advance media by pick-up roller 320, as discussed above relative to the measurement of the length of top piece of medium 371. Alternatively, a motorized media input tray (not shown) can include the stack of media 370, including top piece of medium 371. The motorized media input tray can be moved in and out, parallel to paper load entry direction 302 in order to load media, or to put media at the proper position for picking and feeding media from the tray. For measurement of manufacturer's markings, the motorized media input tray can move the stack of media 370 at a constant velocity to cause incident light beam 361 to be scanned across the manufacturer's markings. If linear photosensor array is aligned parallel to paper load entry direction 302, the spacings or widths can be measured in similar fashion to that described above relative to moving light source 360.

Figure 10A:
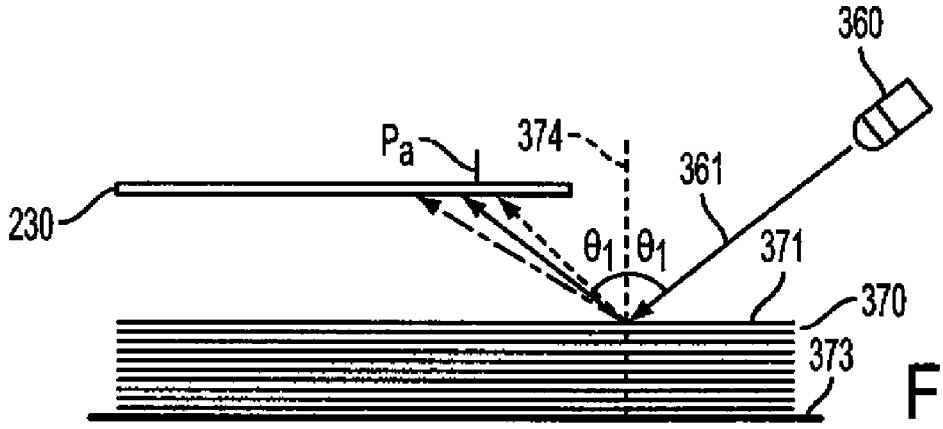
FIGS. 10*a* and 10*b* show embodiments of the present invention where the light beam is scanned by rotating the light source.
Figure 10B:
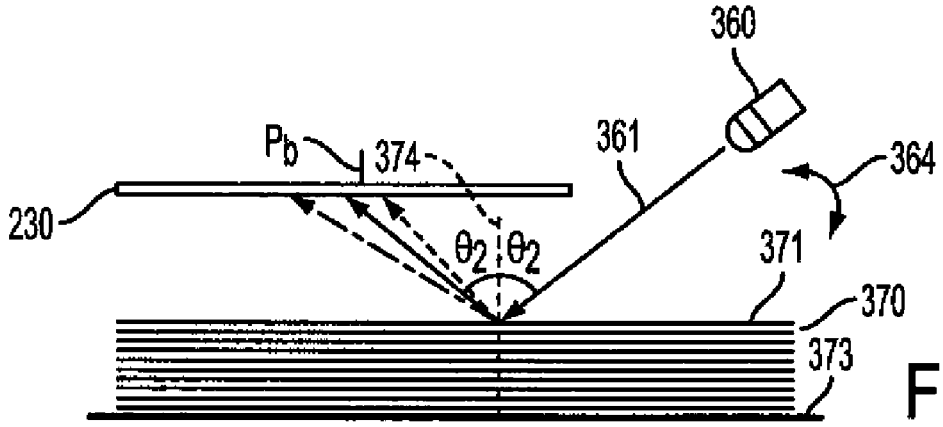

Incident light beam 361 can alternatively be scanned across the surface of top piece of medium 371 by rotating light source 360 or by rotating an intervening, optical element. FIG. 10*a* shows a view similar to FIG. 6*b*, where light source 360 emits a light beam 361 at a first predetermined angle $\theta_1$ relative to normal 374. The output signal of linear photosensor array 230 has a peak located at peak position $P_a$ corresponding to specular reflection of incident light beam 361 at an angle equal to $\theta_1$. In FIG. 10*b*, the stack height has not changed, but the light source 360 has been rotated along rotational direction 364 so that light beam 361 is emitted at a second predetermined angle $\theta_2$ relative to normal 374. The output signal of linear photosensor array 230 has a peak located at a different peak position $P_b$ corresponding to specular reflection of incident light beam 361 at an angle equal to $\theta_2$. Incident light beam 361 also struck top piece of medium 371 in a different position in FIG. 10*b* than in FIG. 10*a*. In this way the beam 361 can be scanned across the top piece of medium 371. When the incident beam 361 hits a light absorbing manufacturer's mark, the amplitude of the peak decreases. If the light source 360 is rotated at a constant speed, the incident light beam 360 is scanned at a constant speed. One additional complexity of methods using a rotationally scanned beam is that as θ increases, the width of the impinging spot of the incident light beam 361 on top piece of medium 371 also increases. Thus, even if no markings are encountered, as θ increases the peak broadens and the peak amplitude decreases. These changes need to be separated out when interpreting the measurement of manufacturer's markings.

Figure 11A:
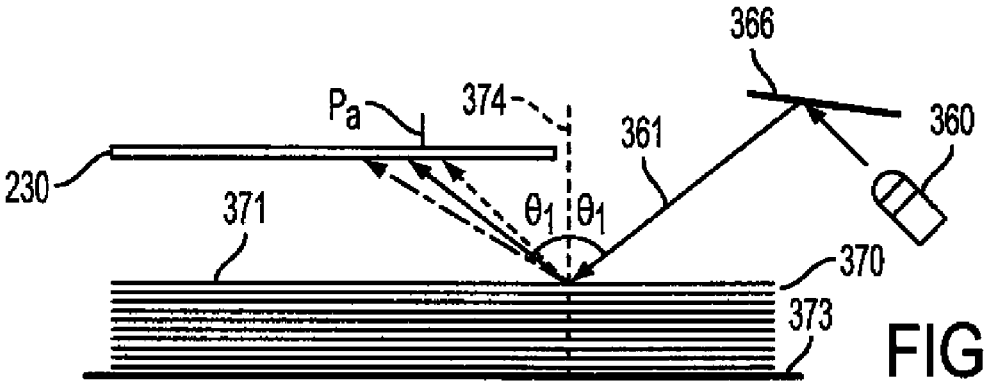
FIGS. 11*a* and 11*b* show embodiments of the present invention where the light beam is scanned by rotating an intervening optical element.
Figure 11B:
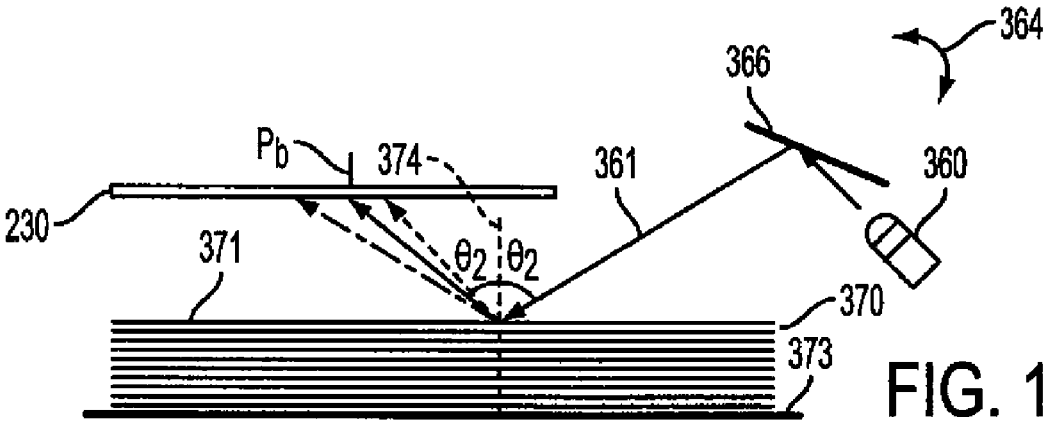

In other embodiments, an optical element 366 is provided in an optical path between light source 360 and top sheet of medium 371 and the optical element can be rotated to scan incident light beam 361 across top sheet of medium 371 as shown in FIGS. 11*a* and 11*b*. Optical element 366 can be a mirror, a prism or a beamsplitter, for example. FIG. 11*a* is similar to FIG. 10*a*, except the first predetermined angle $\theta_1$ is provided by the orientation of optical element 366. In FIG. 11*b*, optical element 366 has been rotated along rotational direction 364 to provide incident light beam 361 at second predetermined angle $\theta_2$.

As discussed above, planar surface 373 of media input location 372 can include a hole, a light deflector or a light absorber, for detecting the absence of media at the media input location. Planar surface 373 alternatively (or in addition), can have a scattering surface that can be used to calibrate the individual photosensors 236 of linear photosensor array 230 when there is no media present at media input location 372. In one exemplary embodiment, the scattering surface provides a more nearly uniform illumination of photosensors 236 along linear photosensor array 230. Using this uniform illumination, deviations from uniform signal output can be used to adjust or compensate the output signal during measurements of the stack of media 370 when media is present. In an alternative embodiment, the incident beam of light can be scanned relative to the scattering surface of planar surface 373 (either by translational movement of the light source 360 or the planar surface 373, or by rotational movement of light source 360 or an intervening optical element 366). Specular reflection of the scanned beam of light can similarly be used to calibrate the linear photosensor array to compensate for nonuniformities in photosensor output.

The invention has been described in detail with particular reference to certain preferred embodiments thereof but it will be understood that variations and modifications can be effected within the spirit and scope of the invention. In particular, embodiments were described with reference to an inkjet printing system, but the invention can also be readily applied to other printing systems or imaging systems such as copiers or scanners.

PARTS LIST

| | |
|---|---|
| 10 | Inkjet printer system |
| 12 | Image data source |
| 14 | Controller |
| 15 | Image processing unit |
| 16 | Electrical pulse source |
| 18 | First fluid source |
| 19 | Second fluid source |
| 20 | Recording medium |
| 100 | Inkjet printhead |
| 110 | Inkjet printhead die |
| 111 | Substrate |
| 120 | First nozzle array |

-continued

PARTS LIST

| | |
|---|---|
| 121 | Nozzle(s) in first nozzle array |
| 122 | Ink delivery pathway (for first nozzle array) |
| 130 | Second nozzle array |
| 131 | Nozzle(s) in second nozzle array |
| 132 | Ink delivery pathway (for second nozzle array) |
| 181 | Droplet(s) (ejected from first nozzle array) |
| 182 | Droplet(s) (ejected from second nozzle array) |
| 200 | Carriage |
| 221 | First type recording medium |
| 222 | Second type recording medium |
| 225 | First bar of anchor bar pairs |
| 226 | Second bar of anchor bar pairs |
| 228 | First identification mark (for first type recording medium) |
| 229 | Second identification mark (for second type recording medium) |
| 230 | Photosensor sensor array |
| 236 | Photosensor(s) |
| 250 | Printhead chassis |
| 251 | Printhead die |
| 253 | Nozzle array |
| 254 | Nozzle array direction |
| 256 | Encapsulant |
| 257 | Flex circuit |
| 258 | Connector board |
| 262 | Multi-chamber ink supply |
| 264 | Single-chamber ink supply |
| 300 | Printer chassis |
| 302 | Paper load entry direction |
| 303 | Print region |
| 304 | Media advance direction |
| 305 | Carriage scan direction |
| 306 | Right side of printer chassis |
| 307 | Left side of printer chassis |
| 308 | Front of printer chassis |
| 309 | Rear of printer chassis |
| 310 | Hole (for paper advance motor drive gear) |
| 311 | Feed roller gear |
| 312 | Feed roller |
| 313 | Forward rotation direction (of feed roller) |
| 316 | Lead edge sensor |
| 317 | Arm |
| 320 | Pick-up roller |
| 322 | Turn roller |
| 323 | Idler roller |
| 324 | Discharge roller |
| 325 | Star wheel(s) |
| 330 | Maintenance station |
| 360 | Light source |
| 361 | Light beam |
| 364 | Rotational direction |
| 366 | Optical element |
| 370 | Stack of media |
| 371 | Top piece of medium |
| 372 | Media input location |
| 373 | Planar surface (at media input location) |
| 374 | Normal (dashed line to media input location) |
| 380 | Carriage motor |
| 382 | Carriage guide rail |
| 383 | Encoder fence |
| 384 | Belt |
| 390 | Printer electronics board |
| 392 | Cable connectors |
| 410 | Output signal |
| 415 | Peak |
| 420 | Output signal |
| 425 | Peak |
| 430 | Output signal |
| 435 | Peak |
| 510, 520, 530, 540, 550, 560, 570, 580 | Step(s) |
| 605, 610, 620, 630, 640, 650, 660, 670, 680, 690 | Step(s) |

The invention claimed is:

1. A method for measuring one or more dimensions of a stack of medium in a media input location of an imaging system, the method comprising the steps of:

providing a media input location including a planar surface for receiving the stack of medium, the planar surface having a normal;

providing a light source for emitting a beam of light along a direction that is at a predetermined angle with respect to the normal of the planar surface of the media input location;

providing an array of photosensors disposed along an array direction that lies in a plane defined by the direction of the beam of light and the normal of the planar surface;

providing a printing system controller;

receiving a spatially-varying pattern of light in the photosensors of the photosensor array, the spatially-varying pattern of light having been reflected from a surface that is substantially parallel to the planar surface of the media input location, to provide corresponding electronic signal data from the photosensor array, the electronic signal data varying along the photosensor array;

transmitting the varying electronic signal data to the printing system controller;

using the varying electronic signal data to provide a measurement of the one or more dimensions corresponding to the stack of medium, wherein the one or more dimensions is a change in the height of the stack of medium;

providing a media advance system to advance medium from the media input location along a media advance direction;

emitting the beam of light from the light source to reflect off the first piece of medium;

receiving the spatially varying pattern of light from the first piece of medium;

transmitting the varying electronic signal corresponding to the first piece of medium to the printing system controller;

advancing the first piece of medium to expose a second piece of medium to the beam of light;

emitting the beam of light from the light source to reflect off the second piece of medium;

receiving the spatially varying pattern of light from the second piece of medium;

transmitting the varying electronic signal corresponding to the second piece of medium to the printing system controller; and comparing the varying electronic signal corresponding to the first piece of medium to the varying electronic signal corresponding to the second piece of medium to measure the change in the height of the stack of medium.

2. The method claimed in claim 1, wherein the step of emitting a beam of light from the light source further comprises emitting a beam of light that is collimated along the direction that is at the predetermined angle with respect to the normal of the planar surface of the media input location.

3. The method claimed in claim 1, wherein the printing system controller correlates values of signal data to measurements of the one or more dimensions according to a predetermined formula.

4. The method claimed in claim 1, wherein the media input location includes either, a hole, a light deflector, a scattering surface or a light absorber for detecting the absence of medium within the media input location.

5. The method claimed in claim 1, wherein the step of comparing the varying electronic signal corresponding to the first piece of medium to the varying electronic signal corresponding to the second piece of medium includes monitoring a shift in a peak signal along the photosensor array.

6. The method claimed in claim 5 wherein monitoring the shift in a peak signal along the photosensor array further comprises determining monitoring a plurality of shifts in the peak signal.

7. The method claimed in claim 1, wherein the change in the height of the stack of the medium is interpreted by the printing system controller as thickness of the first piece of medium.

8. The method claimed in claim 1, wherein the change in the height of the stack of the first medium is interpreted by the printing system controller as an advancement of a plurality of pieces of medium.

9. The method claimed in claim 1, wherein the planar surface of the media input location further comprises a surface for specular reflection of the beam of light, and wherein the method further comprises the steps of:

scanning the beam of light across the surface for sequential specular reflection of the beam of light along the array of photosensors; and using the electronic signals from the sequential specular reflection to calibrate the array of photosensors.

10. A method for measuring one or more dimensions of a stack of medium in a media input location of an imaging system, the method comprising the steps of:

providing a media input location including a planar surface for receiving the stack of medium, the planar surface having a normal;

providing a light source for emitting a beam of light along a direction that is at a predetermined angle with respect to the normal of the planar surface of the media input location;

providing an array of photosensors disposed along an array direction that lies in a plane defined by the direction of the beam of light and the normal of the planar surface;

providing a printing system controller;

receiving a spatially-varying pattern of light in the photosensors of the photosensor array, the spatially-varying pattern of light having been reflected from a surface that is substantially parallel to the planar surface of the media input location, to provide corresponding electronic signal data from the photosensor array, the electronic signal data varying along the photosensor array;

transmitting the varying electronic signal data to the printing system controller; and using the varying electronic signal data to provide a measurement of the one or more dimensions corresponding to the stack of medium, wherein at least one of the one or more dimensions being a variable height of the surface of a first piece of medium relative to the planar surface of the media input location, and wherein one or more photosensors in the photosensor array will receive an increased amount of light dependent upon the variable height dimension of the first piece of medium, the predetermined angle of the emitted beam of light, and the location of the one or more photosensors within the photosensor array.

11. The method claimed in claim 10, wherein the step of emitting a beam of light from the light source further comprises emitting a beam of light that is collimated along the direction that is at the predetermined angle with respect to the normal of the planar surface of the media input location.

12. The method claimed in claim 10, wherein the printing system controller correlates values of signal data to measurements of the one or more dimensions according to a predetermined formula.

13. The method claimed in claim 10, wherein the media input location includes either, a hole, a light deflector, a scattering surface or a light absorber for detecting the absence of medium within the media input location.

14. A method for measuring one or more dimensions of a stack of medium in a media input location of an imaging system, the method comprising the steps of:

providing a media input location including a planar surface for receiving the stack of medium, the planar surface having a normal;

providing a light source for emitting a beam of light along a direction that is at a predetermined angle with respect to the normal of the planar surface of the media input location;

providing an array of photosensors disposed along an array direction that lies in a plane defined by the direction of the beam of light and the normal of the planar surface;

providing a printing system controller;

receiving a spatially-varying pattern of light in the photosensors of the photosensor array, the spatially-varying pattern of light having been reflected from a surface that is substantially parallel to the planar surface of the media input location, to provide corresponding electronic signal data from the photosensor array, the electronic signal data varying along the photosensor array;

transmitting the varying electronic signal data to the printing system controller;

using the varying electronic signal data to provide a measurement of the one or more dimensions corresponding to the stack of medium, wherein the one or more dimensions being a length of the first piece of medium, and wherein a photosensor in the array of photosensors is located at a predetermined distance from a first end of the first piece of medium;

providing a clock within the printing system controller;

providing a media advance system to advance medium from the media input location along a media advance direction;

emitting a beam of light from the light source to reflect off the first piece of medium;

receiving the spatially varying pattern of light from the first piece of medium;

transmitting the varying electronic signal corresponding to the first piece of medium to the printing system controller;

using the printing system controller to monitor the clock; advancing the first piece of medium at a predetermined rate to expose a second piece of medium to the beam of light;

emitting a beam of light from the light source to reflect off the second piece of medium;

receiving the spatially varying pattern of light from the second piece of medium;

transmitting the varying electronic signal corresponding to the second piece of medium to the printing system controller;

monitoring the time at which the electronic signal changes in the photosensor located at the predetermined distance from the first end of the first piece of medium; and comparing the time at which advancing the first piece of medium began, the time at which the electronic signal changes in the photosensor, the predetermined distance from the photosensor to the first end of the first piece of medium, and the predetermined rate of advancing the first piece of medium in order to provide a measurement of the length of the first piece of medium.

15. The method claimed in claim 14, wherein the step of emitting a beam of light from the light source further comprises emitting a beam of light that is collimated along the direction that is at the predetermined angle with respect to the normal of the planar surface of the media input location.

16. The method claimed in claim 14, wherein the printing system controller correlates values of signal data to measurements of the one or more dimensions according to a predetermined formula.

17. A method for measuring one or more dimensions of a stack of medium in a media input location of an imaging system, the method comprising the steps of:

providing a media input location including a planar surface for receiving the stack of medium, the planar surface having a normal;

providing a light source for emitting a beam of light along a direction that is at a predetermined angle with respect to the normal of the planar surface of the media input location;

providing an array of photosensors disposed along an array direction that lies in a plane defined by the direction of the beam of light and the normal of the planar surface;

providing a printing system controller;

receiving a spatially-varying pattern of light in the photosensors of the photosensor array, the spatially-varying pattern of light having been reflected from a surface that is substantially parallel to the planar surface of the media input location, to provide corresponding electronic signal data from the photosensor array, the electronic signal data varying along the photosensor array;

transmitting the varying electronic signal data to the printing system controller;

using the varying electronic signal data to provide a measurement of the one or more dimensions corresponding to the stack of medium, wherein the one or more dimensions being a dimension corresponding to predetermined markings on a surface of the first piece of the medium;

scanning the beam of light across the surface of a first piece of medium at a predetermined scan rate;

sequentially receiving spatially-varying patterns of light in the photosensors of the photosensor array, the scanned beam of light having been reflected from the first piece of medium, to provide corresponding electronic signal data from the photosensor array, the electronic signal data varying along the photosensor array;

transmitting the sequentially received varying electronic signal data to the printing system controller; and using the sequentially received varying electronic signal data to provide a measurement of the distance between predetermined markings on the surface of the first piece of medium.

18. The method claimed in claim 17, wherein the step of scanning the beam of light further comprises moving the light source translationally.

19. The method claimed in claim 17, wherein the step of scanning the beam of light further comprises moving the light source rotationally.

20. The method claimed in claim 17, wherein the method further comprises:

providing an optical element located in an optical path between the light source and the surface of the first piece of medium; and rotating the optical element.

21. The method claimed in claim 20, wherein the optical element is either a mirror, or a prism, or a beam splitter.

22. The method claimed in claim 17, wherein the step of scanning the beam of light further comprises moving the first piece of medium.

23. The method claimed in claim 22, wherein moving the first piece of medium further comprises moving the stack of medium.

24. A method for measuring one or more dimensions of a stack of medium in a media input location of an imaging system, the method comprising the steps of:

providing a media input location including a planar surface for receiving the stack of medium, the planar surface having a normal;

providing a light source for emitting a beam of light along a direction that is at a predetermined angle with respect to the normal of the planar surface of the media input location;

providing an array of photosensors disposed along an array direction that lies in a plane defined by the direction of the beam of light and the normal of the planar surface;

providing a printing system controller;

receiving a spatially-varying pattern of light in the photosensors of the photosensor array, the spatially-varying pattern of light having been reflected from a surface that is substantially parallel to the planar surface of the media input location, to provide corresponding electronic signal data from the photosensor array, the electronic signal data varying along the photosensor array;

transmitting the varying electronic signal data to the printing system controller;

using the varying electronic signal data to provide a measurement of the one or more dimensions corresponding to the stack of medium, wherein the planar surface of the media input location further comprises a surface for scattered reflection of the beam of emitted light, and using the varying electronic signal data from a scattered reflection of the beam of emitted light to calibrate the array of photosensors.

* * * * *